US009550612B2

(12) United States Patent
Wellman

(10) Patent No.: US 9,550,612 B2
(45) Date of Patent: Jan. 24, 2017

(54) CLOSURE WITH SECOND DISPENSING COMPARTMENT

(75) Inventor: Craig John Wellman, Ingleburn (AU)

(73) Assignee: VITALIA INTERNATIONAL PTY LTD., Sydney (AU)

( * ) Notice: Subject to any disclaimer, the term of this patent is extended or adjusted under 35 U.S.C. 154(b) by 2088 days.

(21) Appl. No.: 12/094,262

(22) PCT Filed: Jun. 30, 2006

(86) PCT No.: PCT/AU2006/000932

§ 371 (c)(1),
(2), (4) Date: May 29, 2009

(87) PCT Pub. No.: WO2007/003001

PCT Pub. Date: Jan. 11, 2007

(65) Prior Publication Data

US 2009/0242561 A1 Oct. 1, 2009

(30) Foreign Application Priority Data

Jul. 1, 2005 (AU) ..... 2005903505

(51) Int. Cl.
*B65D 25/08* (2006.01)
*B65D 51/28* (2006.01)

(52) U.S. Cl.
CPC ..... *B65D 51/2828* (2013.01); *B65D 51/2857* (2013.01)

(58) Field of Classification Search
USPC ..... 220/522, 281; 215/227, 255, 228, 250, 215/253; 222/81, 83
See application file for complete search history.

(56) References Cited

U.S. PATENT DOCUMENTS

| | | | | | |
|---|---|---|---|---|---|
| 3,347,410 | A | | 10/1967 | Schwartzman | |
| 4,969,574 | A | * | 11/1990 | Shastal | 220/269 |
| 4,982,875 | A | * | 1/1991 | Pozzi et al. | 222/83 |
| 5,080,245 | A | * | 1/1992 | Conard | 215/249 |
| 5,524,788 | A | * | 6/1996 | Plester | 220/522 |
| 5,950,819 | A | * | 9/1999 | Sellars | 206/221 |
| 5,979,164 | A | * | 11/1999 | Scudder et al. | 62/4 |

(Continued)

FOREIGN PATENT DOCUMENTS

| | | |
|---|---|---|
| AU | 199719972 A1 | 11/1997 |
| AU | 200227637 B2 | 5/2002 |

(Continued)

*Primary Examiner* — Fenn Matthew
*Assistant Examiner* — Kevin Castillo
(74) *Attorney, Agent, or Firm* — Drinker Biddle & Reath LLP

(57) ABSTRACT

A closure (10) for mounting at an opening (O) of a container spout (S) comprises a compartment (32) in which material such as a tablet (T) can be positioned. The compartment comprises a wall (26) that comprises a first region (28) that is surrounded by a second bellows-like region (30) that enables the first region to be displaced from a first position to a second position to cause the material to be released from the compartment. The wall can comprise a protrusion (X) that extends into the compartment such that, when the wall is displaced to the second position, the protrusion can cause the material to be released from the compartment. Also, when the wall is displaced to the second position the first region can act directly on the material to force it out of the compartment.

14 Claims, 6 Drawing Sheets

(56) References Cited

U.S. PATENT DOCUMENTS

| | | | | |
|---|---|---|---|---|
| 6,364,103 | B1 * | 4/2002 | Sergio et al. | 206/222 |
| 6,571,994 | B1 * | 6/2003 | Adams et al. | 222/521 |

FOREIGN PATENT DOCUMENTS

| | | | |
|---|---|---|---|
| AU | 2005203105 | A1 | 2/2006 |
| WO | WO 99/44901 | A1 | 9/1999 |
| WO | WO 00/35758 | A2 | 6/2000 |
| WO | WO 03/051744 | A1 | 6/2003 |
| WO | WO 2005/012133 | A1 | 2/2005 |

* cited by examiner

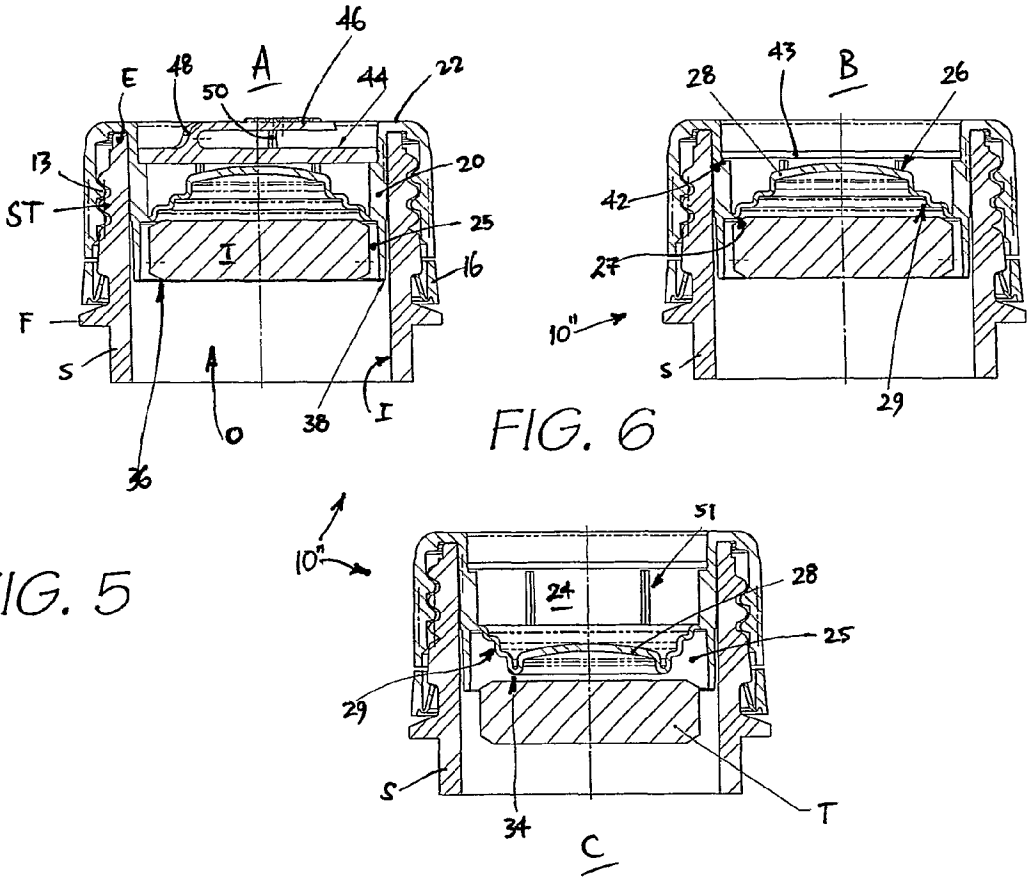
FIG. 6
FIG. 5
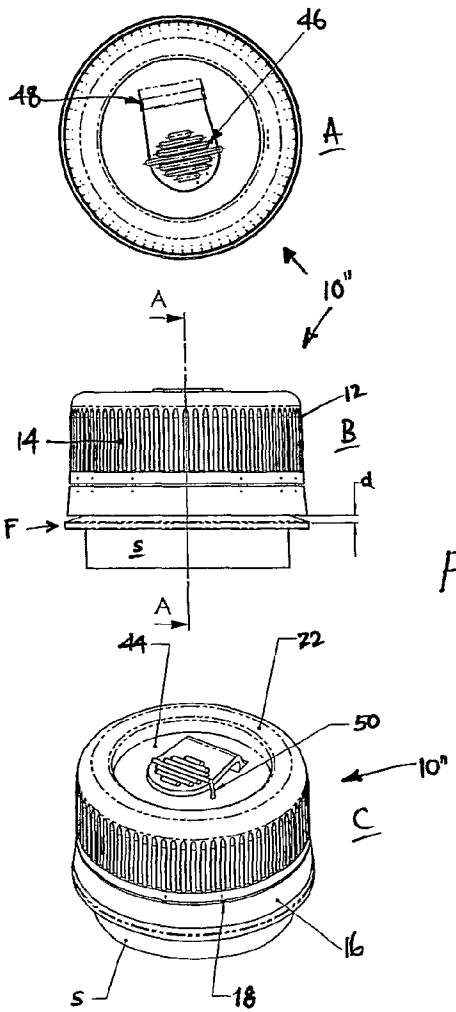

CLOSURE WITH SECOND DISPENSING COMPARTMENT

TECHNICAL FIELD

A closure for a container is disclosed. The closure finds particular though not exclusive application in the dispensing of substances into the container (eg. tablets, pills, powders, liquids etc).

BACKGROUND ART

Closures are known for the holding and dispensing of substances into containers. However, at least some such closures employ constructions that are complex to manufacture and thus relatively costly.

For example, WO 00/27717 discloses a discharge cap for a releasable tablet. However, a number of different outer cap constructions are disclosed that in turn each act on a separate envelope enclosing the tablet, to force a rupture of the envelope and release the tablet into a container. These configurations therefore each represent a more complex and thus costly means of holding and dispensing a tablet into a container.

A reference herein to prior art is not an admission that the prior art forms part of the common general knowledge of a skilled person in the art in Australia or elsewhere.

SUMMARY

In a first aspect there is provided a closure for mounting at an opening to a container, the closure comprising a compartment in which material can be positioned, the compartment comprising a wall, the wall comprising a first region that is surrounded by a second bellows-like region adapted to facilitate displacement of the first region from a first position to a second position to cause the material to be released from the compartment.

The bellows-like region can provide for considerable flexibility in the operation of the closure whilst also enabling the closure, including the compartment wall, to be moulded as a unitary construction. This represents a considerable simplification to previous approaches.

The terminology "bellows-like" is to be interpreted broadly and, as described below, encompasses both corrugated and stepped profiles. However, it can include other profiles such as saw-tooth, square-wave, castellated, etc. The terminology thus embraces bellows-like or compressed configurations of the second region that facilitate displacement of the first region. Such compressed configurations enable a compact closure to be produced whilst facilitating compartment wall displacement for material release.

In a second aspect there is provided a closure for mounting at an opening to a container, the closure comprising a compartment in which material can be positioned, the compartment comprising a wall, the wall comprising a protrusion that extends into the compartment, the wall being displaceable from a first position to a second position whereby the protrusion causes the material to be released from the compartment.

In the second aspect the employment of a protrusion enables liquids and flowable solids (such as powders and granules etc) to be employed in the compartment, again representing a considerable benefit over previous approaches, which have usually been confined to the dispensing of tablets. The protrusion can also facilitate better dispensing of solids such as tablets by physically forcing them out of the compartment.

In a third aspect there is provided a closure for mounting at an opening to a container, the closure comprising a compartment in which material can be positioned, the compartment comprising a wall that defines one side of the compartment in which the material is positioned in use, the wall comprising a first region that can be displaced, relative to a remainder of the wall, from a first position to a second position whereby in use the first region acts directly on the material to force it out of the compartment.

In the third aspect, because the first region itself directly acts on the material to force it out of the compartment, the closure, including the compartment wall, can again be moulded as a unitary construction. Again, this represents a considerable simplification to previous approaches.

The bellows-like region can employ a corrugated or a stepped profile. When corrugated, the bellows-like region can stretch out to facilitate displacement of the first region from the first to the second position. When stepped, the bellows-like region can invert to facilitate displacement of the first region from the first to the second position. In either case, the bellows-like region can be annular and surround the first region. In this regard, the first region may thus be manually displaced (eg. by being depressed) by a user.

The protrusion can engage and cause the rupture of an opposing compartment wall, ie. as the wall is being displaced from the first to the second position. For example, the protrusion can be provided as a spike-like construction that is adapted to pierce the opposing compartment wall as the wall is displaced from the first to the second position. The opposing wall may comprise a pierceable membrane. Also, the protrusion can extend from the first region (eg. extending centrally therefrom).

In one embodiment, the first region can provided as a generally dome-shaped portion that is centrally located in the wall and which does not invert when displaced to the second position. This non-inversion can assist with material release, as described hereafter. The dome-shape can facilitate and indicate manual displacement by a user (eg. by a depressing or pushing action).

To further facilitate displacement of the first region to the second position, the dome-shaped portion can be formed to have a relatively rigid construction compared to a remainder of the wall (eg. compared to the second bellows-like region). The remainder of the wall may also have a thin profile as compared with the dome-shaped portion. Thus, the translational displacement and rigidity of the dome-shaped portion can be used to drive material (eg. tablets, pills, powders, granules, liquids etc) out of the compartment.

In one embodiment the compartment wall can be located within a recess defined in the closure (eg. wholly within). This location can reduce the size of the closure (eg. to a size comparable to an existing closure). This location can also protect the compartment wall (eg. from accidental displacement). Further, it can enable it to be configured in a tamper resistant format, as described below.

For compactness, the compartment can be located wholly within the closure. The compartment is also typically defined on an opposite side of the compartment wall to the recess, with the compartment wall being accessed via the recess and displaced away from the recess. This displacement of the compartment wall can be used to reduce the compartment volume, and this can be used to force material out of the compartment.

In one embodiment a membrane can be positioned along one side of the compartment to enclose the material therein in use. The membrane is typically a metallised plastic foil or film. The membrane can then be detached, displaced or ruptured when the compartment wall is displaced to the second position, and this can represent a simple way of enabling material release from the compartment (ie. the membrane can represent a weakness in the compartment whereby, once the membrane is detached, displaced or ruptured, it may simply allow for material release). Further, in this embodiment, the membrane can define a side of the compartment that is opposed to the compartment wall.

The closure may be adapted for releasable mounting to a container having an opening surrounded by a rim (eg. as defined at a neck or spout of the container). The closure may then comprise an external peripheral wall that surrounds the rim when the closure is mounted to the container. A tamper evident band can be frangibly connected to a distal end of the closure external wall, and the band can either be configured to remain attached to the container when the closure is removed from the container, or can define a tear strip that requires removal to enable closure removal from the container.

Typically the closure is has a generally cylindrical construction and the external wall and rim are respectively internally and externally threaded to enable screw mounting/dismounting of the closure to and from the container.

Further the external peripheral wall can be connected to an internal wall of the closure that is inset from and that faces and is surrounded by the external wall. The internal wall can project into the opening at the rim when the closure is mounted to the container. For example, the internal wall can have a dimension such that it sealingly abuts an inner surface of the rim when the closure is mounted to the container, to assist with sealing in container contents in use.

To facilitate a unitary construction of the closure, a periphery of the compartment wall can be connected to the internal wall. The membrane can also be attached around its periphery to a distal end edge of the internal wall. The distal end edge of the internal wall can be located internally of the closure and can be provided with a width that varies moving around the edge. This variation can facilitate membrane detachment from the end edge when the compartment wall is displaced into the inverted position. For example, the distal end edge can have a generally constant width around the edge save for a discrete relatively wider edge section, whereby, when the compartment wall is displaced into the inverted position, the edge configuration allows for membrane detachment from the end edge except at the wider section. This can prevent the membrane from dropping into the container (which can be dangerous if the container is holding a comestible liquid).

The external peripheral wall can be connected to the internal wall via an annular land, the land defining an outer upper face of the closure in use and also sealing inwardly against an end of the rim when the closure is mounted to the container.

Further, the recess can be defined within and be surrounded by the internal wall to extend generally centrally into the closure.

A step can be defined in an inner periphery of the internal wall adjacent to the land, whereby a periphery of a disc-like element can be located to be received against the step, with the disc-like element then restricting any access to the compartment wall via the recess. The disc-like element can be mounted via a hinge to the closure and may comprise but a liftable portion which, when lifted, enables the disc-like element to be pivoted about the hinge and away from the closure. The liftable portion can be located centrally within and also be connected to the disc-like element via a hinge about which it pivots when lifted. For tamper evidency, the liftable projection can also be separately connected to the disc-like element via a frangible bridge, the severance of which enables the portion to be lifted and pivoted about the hinge but which also indicates such tampering.

In one embodiment the compartment is shaped to house material in the form of a tablet having a squat cylindrical shape. The same (or a different) compartment shape can house material in the form of a liquid, or a flowable solid such as a powder or granules etc.

The compartment can have a dimension such that a face of the tablet abuts an inner surface of membrane whereby, when the compartment wall is displaced from the first to the second position, the tablet causes the membrane to detach, displace or rupture such that the tablet can be released from the compartment.

The tablet may optionally be provided with a shape that enhances its causing of the membrane to detach, displace or rupture. For example, the tablet may project to at least one point (and in some cases two points) which can pierce the membrane.

Thus, in a further aspect a tablet is provided that has a shape that projects to at least one point, whereby the tablet point may pierce the membrane.

In one embodiment, when the closure is mounted to the container in use, the material is released through the container opening and into the container (eg. into liquid contents of the container).

Typically the closure is in the form of a cap.

Typically the closure is moulded from polymeric material. For example the compartment wall can be produced by straight coining in a mould, or by using two polymers (bi-material moulding) together with coining. This can produce a rigid closure that incorporates a flexible inverting portion. Further, the coining with two polymers can squeeze out rigid material from a central portion of the compartment wall, to leave the flexible portion in a resulting thin section of the wall. Such a technique may also have broader moulding applications.

In another aspect a container is provided that is fitted with the closure as defined in the aspects above. The container can be a bottle, flask or the like.

BRIEF DESCRIPTION OF THE DRAWINGS

Notwithstanding any other forms that may fall within the scope of the closure as defined in the Summary, specific embodiments of the closure will now be described, by way of example only, with reference to the accompanying drawings in which:

FIGS. 5A to 5C respectively show plan, front and perspective views of a third closure embodiment;

FIGS. 6A to 6C respectively show sectional views of the third closure embodiment mounted on the container spout, and taken on the line A-A, in assembled, protective disc removed and chamber wall depressed modes;

DETAILED DESCRIPTION OF SPECIFIC EMBODIMENTS

Figure 2:
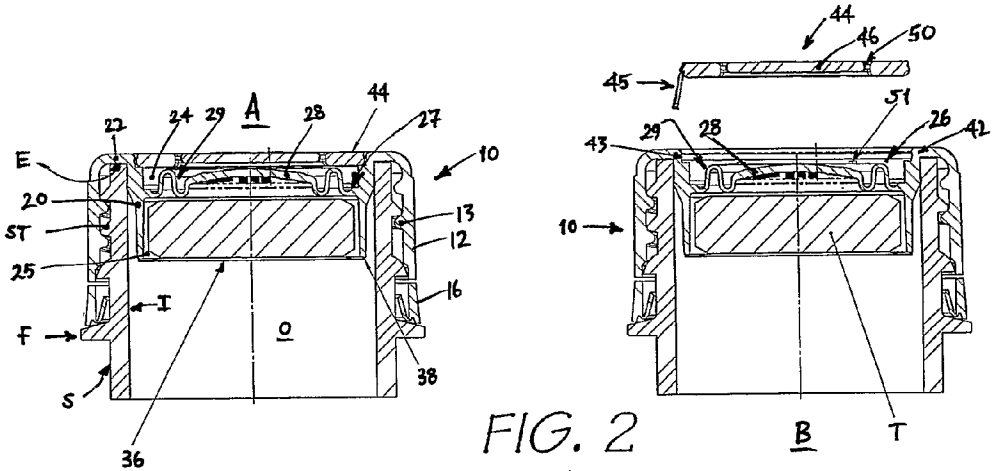
FIGS. 2A to 2C respectively show sectional views of the first closure embodiment mounted on the container spout, and taken on the line A-A, in assembled, protective disc removed and chamber wall depressed modes.
Figure 1:
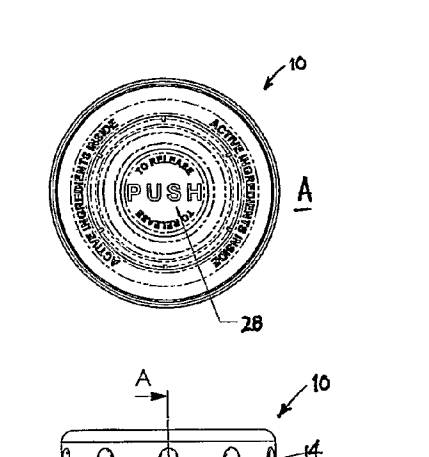
FIGS. 1A to 1C respectively show plan, front and perspective views of a first closure embodiment.
FIG. 1D shows a perspective view of a portion of a container spout to which the closure can be mounted.

Referring firstly to the embodiment of FIGS. 1 and 2, a closure in the form of a cap 10 is shown. The cap 10 is adapted for releasable mounting to a container having an opening surrounded by a rim, which in FIGS. 1 and 2 is a bottle spout S having external threads ST defined above a peripheral flange F. Vents V in the threads ST are provided for build-up gas release during closure removal.

The cap 10 comprises an external peripheral wall 12 that is internally threaded at 13 to surround and threadably engage the spout external threads ST when the cap is mounted to the bottle (FIG. 2). The wall 12 is provided with a plurality of ribs 14 therearound to facilitate gripping during cap screwing/unscrewing to/from the bottle.

A tamper evident band 16 is frangibly connected via bridges 18 to a distal end of the external wall 12. The band can either be configured to remain attached to the bottle spout S when the cap is removed from the bottle, or it can define a tear strip that is torn away to enable cap removal from the bottle. In FIGS. 1 and 2 the band 16 is configured to remain attached, with tamper evidency being indicated by a pronounced drop distance (see distance d in FIG. 5B).

The cap external wall 12 is connected to a cap internal wall 20 via an annular land 22. The internal wall 20 is inset from, faces and is surrounded by the external wall 12.

As best shown in FIG. 2, the internal wall 20 projects into an opening 0 at the bottle spout S when the cap is mounted thereto. The internal wall has an external dimension such that it sealingly abuts an inner surface I of the bottle spout S when the cap is mounted thereto, to assist with sealing in bottle contents (typically a liquid). Further, the land 22 seals inwardly against an end E of the bottle spout when the cap is screwed down onto the bottle.

A recess 24 is defined within and is surrounded by the internal wall 20, the recess extending generally centrally into the cap. A chamber 25 is defined in the cap in an opposing relationship to the recess 24 and houses a material (eg. a tablet T) to be dispensed into the interior of the bottle.

In this regard, a chamber wall 26 is located to extend across the recess 24 and is connected around its periphery via a peripheral hinge 27 to internal wall 20. The chamber wall 26 divides off the chamber 25 from the recess 24.

The chamber wall 26 comprises a dome-shaped central button portion 28 that is connected to hinge 27 via an annular bellows-like region 29, the region 29 having a corrugated profile. Region 29 is adapted to facilitate displacement of the button portion 28 from the position of FIG. 2B to the position of FIG. 2C. in this regard, as the button portion 28 is displaced (eg. depressed by a user's finger/thumb) the region 29 moves from its "compressed" state (shown in FIG. 2B) to a "stretched-out" state (shown in FIG. 2C). The wall 26 also moves about the peripheral hinge 27 as it is displaced. During such displacement a final annular corrugation 30 is caused to act on the tablet T and force it out of the compartment, as described below.

The corrugated profile of region 29 can provide for considerable flexibility in the operation of the cap whilst also enabling the cap to be moulded as a unitary construction.

The recessed location of chamber wall 26 can help protect the wall against accidental or deliberate displacement, thus also providing a preliminary form of tamper resistance.

Material other than tablet T can be positioned in chamber 25 (eg. liquid active, powdered or granulated active etc). The particular tablet T shown has a squat cylindrical shape, but other tablet shapes may be employed as described below. For cap compactness, the chamber 25 is located wholly within the cap. It will be seen that the chamber 25 is defined on an opposite side of the chamber wall 26 to the recess 24. Displacement of the wall 26 thus has the effect of reducing the chamber volume, and this can be used to force the material out of the chamber.

To enable a secure (eg. hermetic) enclosure of material in the chamber, and to facilitate easy release of material from the chamber, a membrane 36 (typically a metallised plastic foil or film) is positioned to define an opposing wall of the chamber and to completely enclose the material therein in use. The membrane is opposed across the chamber to the chamber wall 26 and is attached around its periphery to a distal end edge 38 of the internal wall 20. The membrane is formed such that it can be detached, displaced or ruptured when the chamber wall is displaced into the inverted position (as shown in FIG. 2C) thus providing a simple way to enable material release from the chamber.

The chamber 25 and tablet T typically each have a dimension such that a face of the tablet sits against an inner surface of the membrane and an opposing tablet face sits close to chamber wall 26. Thus, when the chamber wall is displaced downwardly, it is the tablet that causes the membrane to detach, displace or rupture, whereby tablet release from the compartment is readily enabled.

For cap tamper proofing and for cap tamper indication, a step 42 can be defined in the internal wall around its upper periphery. A peripheral rebate 43 can be defined in the step (FIG. 2B) or above the step (FIG. 6B) whereby a disc 44 can be located within the recess 24 to be received against the step and to be snap-locked into the rebate 43 at the periphery of the disc. The step can cause the disc to be recessed as shown, or the step may have less depth such that the disc is positioned generally flush with land 22. Once positioned in the cap, the disc restricts access to the chamber wall via the recess, thereby providing a tamper proofing function.

The disc can be removable entirely from the cap (embodiment of FIGS. 5 and 6), or more preferably remains attached thereto via a projecting tab 45 that is fastened into a recess located in the step 42 and then functions as a hinge. This attachment tab can prevent inadvertent littering, swallowing (eg. by an infant) etc of the disc 44.

To enable its lifting up from the cap, the disc 44 has a usually close-facing but liftable tongue 46 which, when lifted, enables pull-up of the disc from the cap, thereby opening access to the chamber wall 26 via the recess 24. The tongue is connected to the disc at a hinge 48 about which it pivots when lifted. However, another portion of the tongue is connected to the disc via a frangible bridge 50. The severance of this bridge enables projection lifting and pivoting about the hinge and indicates tampering.

A series of support ribs 51 can be defined within the recess 24 and against which an underside of disc 44 sits when fastened into the recess 24. These prevent displacement of the disc 44 into the recess 24, thus preventing inadvertent displacement of chamber wall 26.

Figures 3, 4:
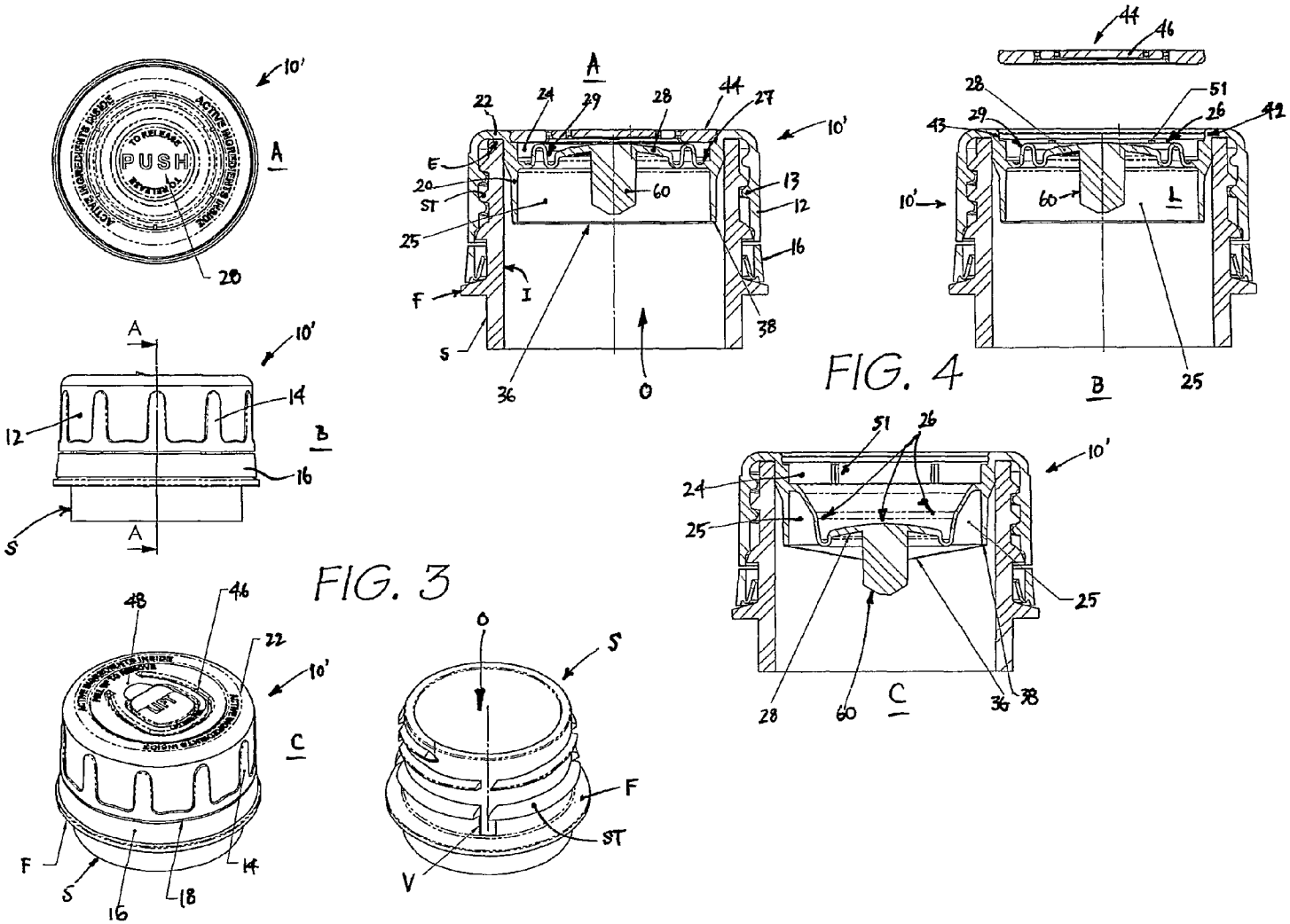
FIGS. 3A to 3C respectively show plan, front and perspective views of a second closure embodiment.
FIG. 3D shows a perspective view of a portion of a container spout to which the closure can be mounted.
FIGS. 4A to 4C respectively show sectional views of the second closure embodiment mounted on the container spout, and taken on the line A-A, in assembled, protective disc removed and chamber wall depressed modes.

Referring now to the embodiment of FIGS. 3 and 4, where like reference numerals are used to denote similar or like parts, the cap 10' is constructed and operates in essentially the same way as that described for the embodiment of FIGS. 1 and 2.

However, in this embodiment a protrusion in the form of a barbed spike 60 is integrally formed with button portion 28 and extends into the chamber 25. When the chamber wall 26 is displaced from the position of FIG. 4B to the position of FIG. 4C the spike 60 is caused to pierce the membrane 36, and release a liquid L or a flowable solid (powder, granules etc) from the chamber and into the bottle. Thus, the membrane can remain attached at the distal end edge 38 of the internal wall 20.

Rather than a spike 60 that pierces the membrane, other protrusion shapes can be employed that engage and cause rupture of an opposing compartment wall (such as a membrane) as the chamber wall 26 is displaced downwardly. Such a protrusion may also be used to force eg. a solid tablet through the membrane. However, the embodiment of FIGS. 3 and 4 is particularly useful where the chamber 25 is used to house a liquid or a flowable solid.

Referring now to the embodiment of FIGS. 5 and 6, where like reference numerals are used to denote similar or like parts, the cap 10" is constructed and operates in essentially the same way as that described for the embodiment of FIGS. 1 and 2, save for the construction and operation of chamber wall 26.

In the embodiment of FIGS. 5 and 6 the chamber wall 26 has a distinct dome-shape, including the button portion 28, and extends up into the recess 24. Again, the chamber wall 26 is connected to hinge 27 via an annular bellows-like region 29. However, in this embodiment the region 29 has a stepped-up profile.

Again, region 29 is adapted to facilitate displacement of the button portion 28 from the position of FIG. 6B to the position of FIG. 6C. In this regard, as the button portion 28 is displaced (eg. depressed by a user's finger/thumb) the region 29 moves from its "stepped-up" state (shown in FIG. 6B) and inverts to a "stepped-down" state (shown in FIG. 6C). Again, the wall 26 moves about the peripheral hinge 27 as it is displaced from the projecting position to the inverted position. Again, during such displacement a final step 34 adjacent to button portion 28 is caused to act on the tablet T and drive it out of the chamber 25, thus rupturing membrane 36.

The stepped profile of region 29 again provides considerable flexibility to the cap whilst again enabling the cap to be moulded as a unitary construction.

The chamber wall 26 is moulded to assume a generally dome-shaped configuration when in the projecting position. Further, a central button portion 28 of the wall 26 is defined in wall 26 and is configured so as not to invert when displaced to the inverted position (FIG. 2C). This non-inversion of button portion 28, whilst not essential, can assist with tablet release, as described below.

The button portion 28 is connected to the peripheral hinge 27 via a stepped annular region 30. The stepped annular region inverts when the wall 26 is displaced from the projecting position to the inverted position, thus facilitating a translational displacement of the button portion 28. This translational displacement can assist with the release of material from the cap.

Figure 10A:
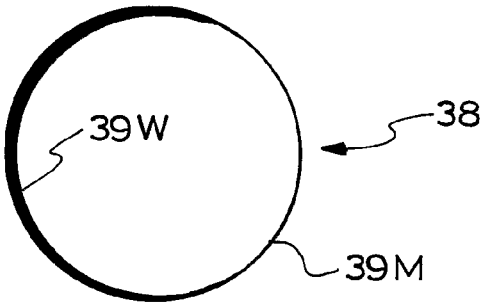
FIGS. 10A and 10B each show an underside detail of two alternative internal wall end edges of the fourth closure embodiment.
Figure 10B:
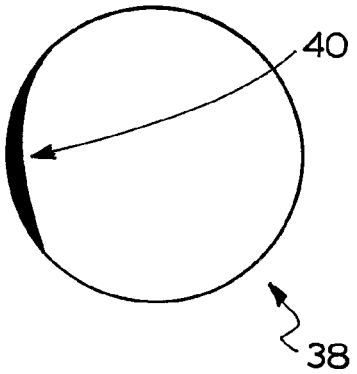
Figure 11:
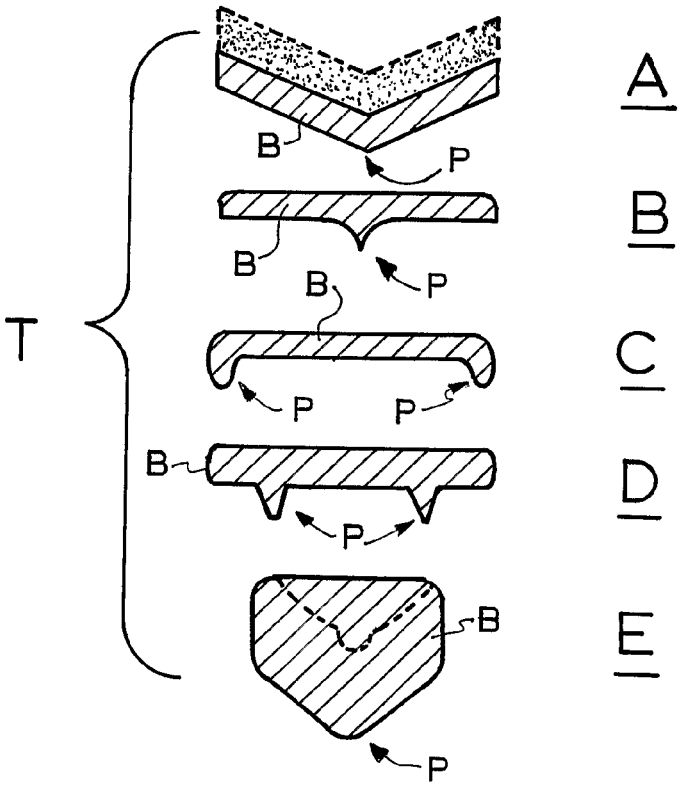
FIGS. 11A to 11E show side views of five different tablet configurations for use with the first to fourth closure embodiments.

Referring now to FIG. 10, the distal end edge 38 of the internal wall 20 can be provided with a width that varies moving around the edge. This variation can facilitate membrane detachment from the end edge when the chamber wall is displaced downwardly. For example, the distal end edge can have opposing narrow 39*n* and wide 39*w* sections (FIG. 10A) or can have a generally constant width around the edge save for a discrete relatively wider edge section 40 (FIG. 103). Thus, when the chamber wall is displaced downwardly, the edge configuration allows for membrane detachment from the end edge except at the wider section 39*w* or 40. This can prevent the membrane from dropping into the bottle (which can be dangerous if the bottle is holding a comestible liquid).

Thus, membrane rupturing can occur by:

- preferentially moulding a thicker wall on one side of the edge 38;
- moulding a constant internal wall section with welding ring or rings and providing additional ring(s), preferentially on one side, to hold the membrane more securely in place when welding the membrane to the cap; or
- creasing, stamping or marking the membrane in a manner which will induce a rupture point—this would then allow the weld rings on the cap to be moulded consistently all the way around.

The chamber wall configuration employed in the cap (ie. whereby wall displacement releases the tablet (or other material) from the chamber) enables the cap to be moulded as a unitary construction, representing a considerable simplification to prior art cap approaches.

Figure 7A:
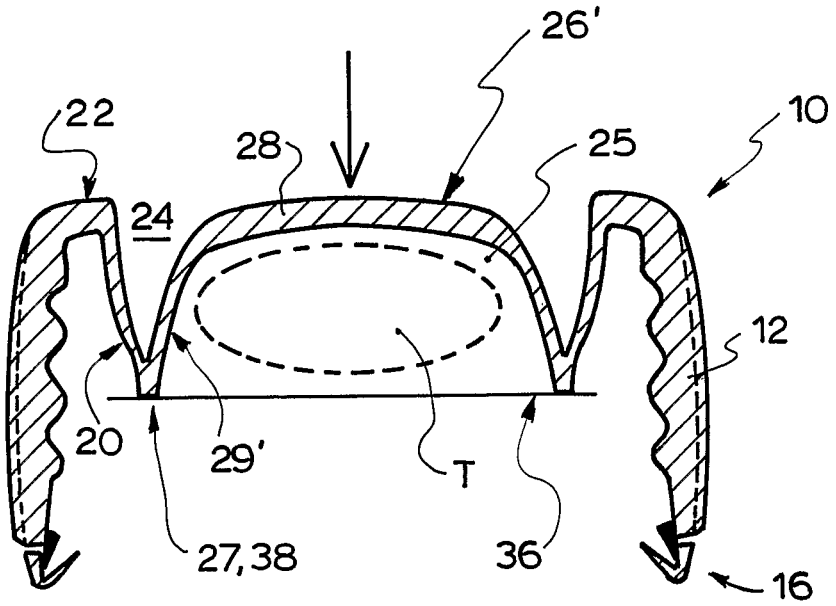
FIGS. 7A and 7B respectively show sectional views of a fourth closure embodiment in assembled and chamber wall depressed modes.
Figure 7B:
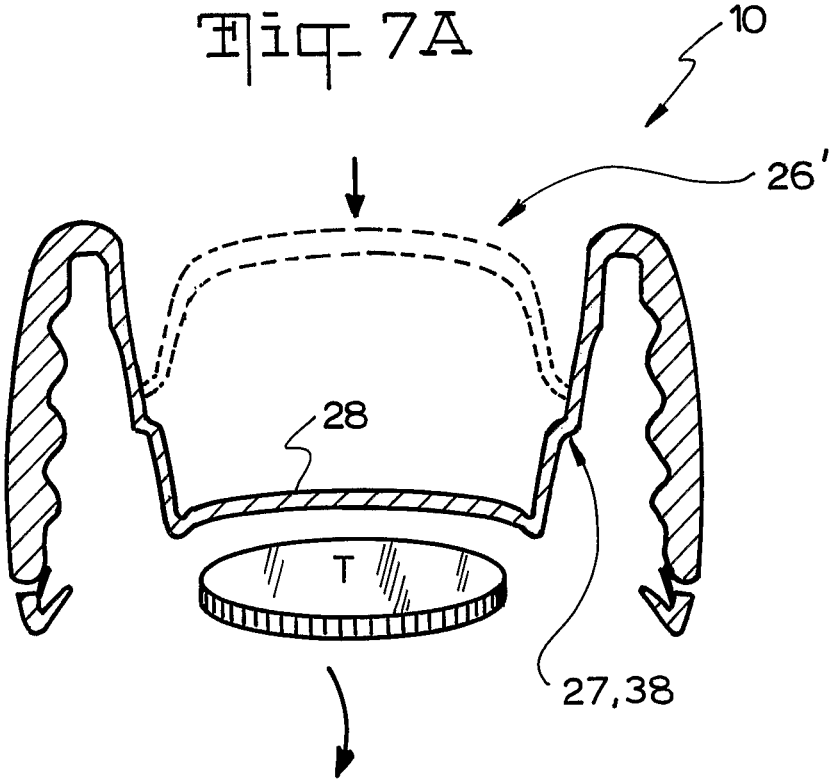

Referring now to the embodiment of FIGS. 7 to 9, where like reference numerals are used to denote similar or like parts, it will be seen that the chamber wall 26' has a more pronounced dome shape. In addition, the membrane 36 is again mounted at the end edge 38 of internal wall 20. However, this edge is also coincident with the peripheral hinge 27.

Further, the button portion 28 is connected to the peripheral hinge 27 via a thinned flexible annular region 29' that can be moulded or formed (such as by coining) to be thinner; or can be bi-moulded to comprise a more flexible polymeric material.

Figure 8A:
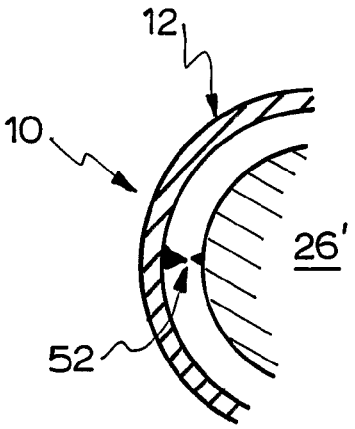
FIGS. 8A and 8B respectively show a plan detail and a side sectional detail of the fourth closure embodiment.
Figure 8B:
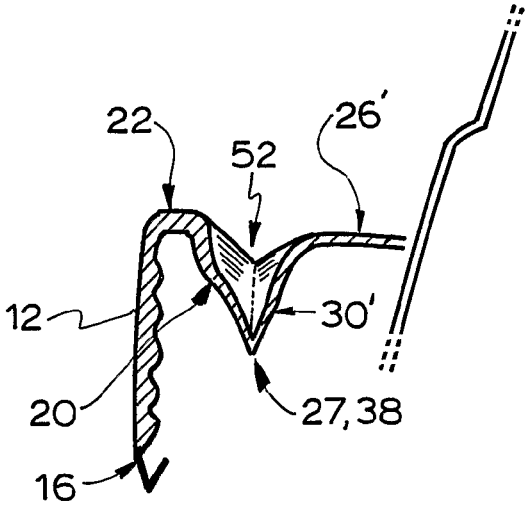

FIGS. 8A and 8B depict the use of a frangible bridge 52 that extends between the chamber wall 26' and the internal wall 20, the or each of which can function to prevent inadvertent displacement of the wall 26', but to also indicate tampering when broken or disturbed.

Figure 9A:
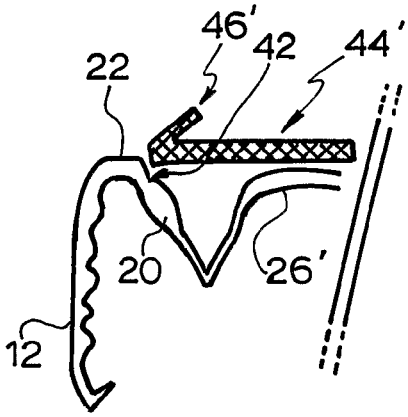
FIGS. 9A and 9B each show a sectional detail of two alternative protective covers for the fourth closure embodiment.
Figure 9B:
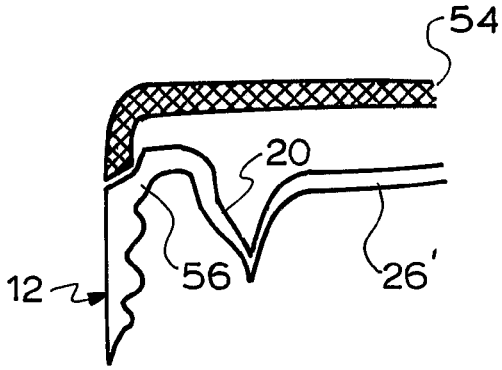

FIG. 9A shows a modified disc 44' located flush with land 22, whereas FIG. 9B shows an overcap 54 in place of disc 44. The overcap 54 can snap-lock into a peripheral rebate 56 defined around the cap external wall 12.

Instead of being squat cylindrical, the tablet T can be provided with a shape that enhances membrane detachment, displacement or rupture. For example, as shown in FIGS. 11A to 11E, tablet shapes can be employed where the tablet projects from a body B to one or two points P, which can in turn more easily pierce the membrane (especially when of foil).

When the cap is mounted to the bottle in use, material can be released through the opening and into the bottle, typically to come into contact and to mix with liquid contents of the bottle.

The chamber wall 26 can be produced by straight coining in a mould or by using a two-component (two-polymer) technology (bi-material moulding) together with coining to produce a rigid closure that incorporates a soft flexible inverting element. Coining with two materials can provide a squeezing out of the rigid material from the middle to leave a flexible (soft) material in the resulting thin section of the moulding.

The cap may also be modified to provide child resistance. For example, additional moulded child-proofing component (s) can be combined into the cap. This allows the cap to house active materials (eg. medicinal or pharmaceutical actives).

In each of the caps shown in FIGS. 1 to 10 the chamber wall 26 itself directly acts on the material to force it out of the chamber 25. This enables the cap to be moulded as a unitary construction, representing another considerable simplification.

The material housed in chamber 25 may comprise a tablet as shown (eg. a flavoured effervescent tablet, a medicament, a sugar-based product etc) or it may be powder, pellets, granules, a liquid etc. When is powder, granule or liquid form the underside of chamber wall 26 may be provided with a spike or probe etc to pierce the membrane when displaced and thereby release the material into the container.

The material may also be coated with eg. a coating that has more limited or different solubility than the material, so that the material becomes exposed to container contents (eg. liquid) after a certain time period. This can provide enhanced aesthetic effects.

The cap enables such materials to be stored hermetically, in a desiccant atmosphere, and yet be selectively delivered into liquid in a bottle or other container (eg. into water, alcohol, spirit or other liquor).

The cap can also be shipped separately to destination to save on transferring liquid containing bottles, containers etc.

Whilst specific embodiments of a closure in the form of a cap have been described, it should be appreciated that the closure can be embodied in many other forms.

In the claims which follow and in the preceding description, except where the context requires otherwise due to express language or necessary implication, the word "comprise" or variations such as "comprises" or "comprising" is used in an inclusive sense (ie. to specify the presence of the stated features but not to preclude the presence or addition of further features in various embodiments).

The invention claimed is:

1. A closure for mounting to a container having an opening surrounded by a rim, the closure being of unitary construction and comprising:

an external peripheral wall that is connected via an annular land to an internal wall that is inset from and that faces and is surrounded by the external wall to form a channel therebetween for receiving the rim, the land defining an outer upper face of the closure in use and sealing inwardly against an end of the rim when the closure is mounted to the container, and a compartment in which material can be positioned, the compartment comprising a wall that is located within a recess defined in the closure, wherein a periphery of the compartment wall is connected to the internal wall such that the internal wall forms a side wall of the compartment, whereby the compartment and compartment wall are located within the container opening when the closure is mounted thereto, and with the compartment wall comprising a first region that is surrounded by a second bellows-like region adapted to facilitate displacement of the first region from a first position to a second position to cause the material to be released from the compartment into the container.

2. A closure as claimed in claim 1 wherein the bellows-like region has a corrugated or a stepped profile.

3. A closure as claimed in claim 1 wherein the bellows-like region is annular and surrounds the first region.

4. A closure as claimed in claim 1 that is adapted for releasable mounting to a container.

5. A closure as claimed in claim 4 wherein the rim is defined by an end region of a neck of the container.

6. A closure as claimed in claim 4 wherein a tamper evident band is frangibly connected to a distal end of the closure external wall.

7. A closure as claimed in claim 6 wherein the band is either configured to remain attached to the container when the closure is removed from the container, or is a tear strip that requires removal to enable closure removal from the container.

8. A closure as claimed in claim 4 that is cylindrical, wherein the external wall and rim are respectively internally and externally threaded to enable screw mounting/dismounting of the closure to and from the container.

9. A closure as claimed in claim 1 wherein the internal wall has a dimension such that it sealingly abuts an inner surface of the rim when the closure is mounted to the container.

10. A closure as claimed in claim 1 wherein a step is defined in an inner periphery of the internal wall adjacent to the land, whereby a periphery of a disc-like element can be located to be received against the step, with the disc-like element then restricting access to the compartment wall.

11. A closure as claimed in claim 10 wherein the disc-like element is mounted via a hinge to the closure and comprises a liftable portion which, when lifted, enables the disc-like element to be pivoted about the hinge and away from the closure.

12. A closure as claimed in claim 11 wherein the liftable portion is located centrally within and is connected to the disc-like element via a hinge about which it pivots when lifted, the liftable portion also being separately connected to the disc-like element via a frangible bridge, the severance of which enables the portion to be lifted and pivoted about the hinge but which also indicates tampering.

13. A closure as claimed in claim 1, wherein a periphery of the membrane is attached to a distal end edge of the internal wall that is located internally of the closure.

14. A closure as claimed in claim 13, wherein the distal end edge of the internal wall has a width that varies moving around the edge to facilitate membrane detachment from the end edge when the compartment wall is displaced to the second position.

* * * * *